US012429235B2

(12) United States Patent
Hill

(10) Patent No.: US 12,429,235 B2
(45) Date of Patent: Sep. 30, 2025

(54) AIR CONDITIONING EXTERNAL UNIT SHADE AND METHOD OF USE

(71) Applicant: Jeffrey Hill, Edmond, OK (US)

(72) Inventor: Jeffrey Hill, Edmond, OK (US)

( * ) Notice: Subject to any disclaimer, the term of this patent is extended or adjusted under 35 U.S.C. 154(b) by 51 days.

(21) Appl. No.: 18/463,824

(22) Filed: Sep. 8, 2023

(65) Prior Publication Data

US 2024/0093889 A1 Mar. 21, 2024

Related U.S. Application Data

(60) Provisional application No. 63/406,801, filed on Sep. 15, 2022.

(51) Int. Cl.

| | |
|---|---|
| ***F24F 1/58*** | (2011.01) |
| *F24F 1/56* | (2011.01) |
| *F24F 13/20* | (2006.01) |

(52) U.S. Cl.
CPC *F24F 1/58* (2013.01); *F24F 1/56* (2013.01); *F24F 13/20* (2013.01)

(58) Field of Classification Search
CPC ..... F24F 1/58; F24F 1/56; F24F 13/20
See application file for complete search history.

(56) References Cited

U.S. PATENT DOCUMENTS 2,914,075 A * 11/1959 Wells ..... F24F 1/04 62/331
2,941,380 A * 6/1960 Garred ..... F24F 13/00 62/262
4,175,480 A * 11/1979 Beam, Jr. ..... F24F 13/20 236/49.5
4,953,328 A * 9/1990 Sewell ..... F24F 1/58 52/473
6,430,954 B1 8/2002 Smith
(Continued)

FOREIGN PATENT DOCUMENTS

| | | |
|---|---|---|
| CN | 108131746 | 6/2018 |
| JP | 2019213829 | 12/2019 |
| KR | 20210134596 | 11/2021 |

OTHER PUBLICATIONS

Uniforu, AC Covers, https://www.amazon.ca/UniForU-Conditioner-Waterproof-Dustproof-Accessories/dp/B08LVQHTSG?th=1.
(Continued)

*Primary Examiner* — Joseph F Trpisovsky
(74) *Attorney, Agent, or Firm* — Margaret S. Millikin

(57) ABSTRACT

A method and apparatus for improving production efficiency of a heating, ventilation and air conditioning system. The present invention provides a shade comprising a frame and a canopy that extends radially from the top of a condenser unit, thereby creating shade over the sides of the condenser unit and creating a separation of heated air above the shade and fresh air below. The canopy is adapted to receive the frame or to be secured to the frame. The frame may comprise a plurality of ribs which are assembled in a configuration that supports the canopy on the frame. The frame is secured to the condenser unit via a variety of securements, including bungee cords and hooks or clips. The canopy is shaped to conform to the condenser unit to effectively shield the condenser unit from the deleterious effects of the sun on at least one or more sides.

21 Claims, 11 Drawing Sheets

(56) References Cited

U.S. PATENT DOCUMENTS

| | | | | |
|---|---|---|---|---|
| 6,595,017 | B1 * | 7/2003 | Teahan | F24F 1/50 62/DIG. 13 |
| 7,032,402 | B2 * | 4/2006 | Braswell | F24F 1/58 62/507 |
| 7,140,194 | B1 | 11/2006 | Miller | |
| 7,707,798 | B1 | 5/2010 | Cullinan | |
| 10,294,684 | B1 | 5/2019 | Shedd | |
| 2003/0226369 | A1 | 12/2003 | Comanescu et al. | |
| 2006/0059935 | A1 | 3/2006 | Braswell | |

OTHER PUBLICATIONS

Airdeko, Aluminum mini split air conditioner cover for outdoor AC, https://www.etsy.com/listing/1141207818/aluminum-mini-split-air-conditioner, Jun. 6, 2023.

Lowes, Khomo Gear Central Air Conditioner Cover, https://www.lowes.com/pd/KHOMO-GEAR-KHOMO-GEAR- Heavy-Duty-Air-Condition-Cover-Gray/5001723713.

Sturdy Covers, AC Defender—All Season Universal Mesh Air Conditioner Cover—AC Cover for Central Units, https://www.amazon.com/Sturdy-Covers-AC-Defender-Universal/dp/B01E9IPRBK/ref=pd_lpo_sccl_1/138-6126330-4320760?pd_rd_w=bbgvo&content-id=amzn1.sym.116f529c-aa4d-4763-b2b6-4d614ec7dc00&pf_rd_p=116f529c-aa4d-4763 b2b6-4d614ec7dc00&pf_rd_r=DZZYXXDYSGBBQNGG4K6J&pd_rd_wg=JIHNy&pd_rd_r=6ee30a86-5053-4210-b80f-.

Besportble, Besportable Air Conditioner Cover Outdoor Air Conditioning Sun Shade Protection (Silver), https://www.amazon.com/BESPORTBLE-Conditioner-Conditioning-Protection-Accessories/dp/B084TTPR6B, Feb. 15, 2020.

* cited by examiner

AIR CONDITIONING EXTERNAL UNIT SHADE AND METHOD OF USE

CROSS-REFERENCE TO RELATED APPLICATIONS

This application claims priority to U.S. provisional patent application Ser. No. 63/406,801, entitled Air Conditioning Shade, filed Sep. 15, 2022, the entirety of which is incorporated herein by reference.

TECHNICAL FIELD OF THE INVENTION

The present invention relates generally to air conditioning systems, and more particularly, but not by way of limitation, to shades for outdoor condenser units for air conditioning systems. Methods of increasing the efficiency of an air conditioning system also are disclosed.

SUMMARY OF THE INVENTION

The present invention is directed to a removable shade for a heating, ventilation and air conditioning system comprising a condenser unit having a top and four sides, the shade comprising: a frame adapted to be secured to the condenser unit, wherein the frame is composed of a lightweight material and is adapted to be secured to the condenser unit proximal the top of the condenser unit and wherein the frame removably connected to the condenser unit without damaging the condenser unit; and a canopy adapted to be secured to the frame, wherein the canopy comprises an integral one-piece unit that, when in assembled configuration with the frame, extends radially and substantially horizontally from the top surface of the condenser unit on at least three sides thereof and forms a shape that substantially shields at least three sides of the condenser unit from the sun; wherein, the shade is adapted to be received in assembled configuration with the compressor in a manner so as not to impede the flow of heated air exiting the condenser unit nor the flow of ambient air entering the condenser unit.

The present invention is further directed to a method of increasing the efficiency of a heating, ventilation, and air conditioning unit comprising a condenser unit having a top and four sides, the method comprising the step of: shading one or more of the sides of the condenser unit from the sun by providing a canopy that extends radially from the condenser unit, wherein the shade comprises: a frame adapted to be secured to the condenser unit, wherein the frame is composed of a lightweight material and is adapted to be secured to the condenser unit proximal the top of the condenser unit and wherein the frame removably connected to the condenser unit without damaging the condenser unit; and a canopy adapted to be secured to the frame, wherein the canopy comprises an integral one-piece unit that, when in assembled configuration with the frame, extends radially and substantially horizontally from the top surface of the condenser unit on at least three sides thereof and forms a shape that substantially shields at least three sides of the condenser unit from the sun.

DETAILED DESCRIPTION OF THE INVENTION

Figure 1:
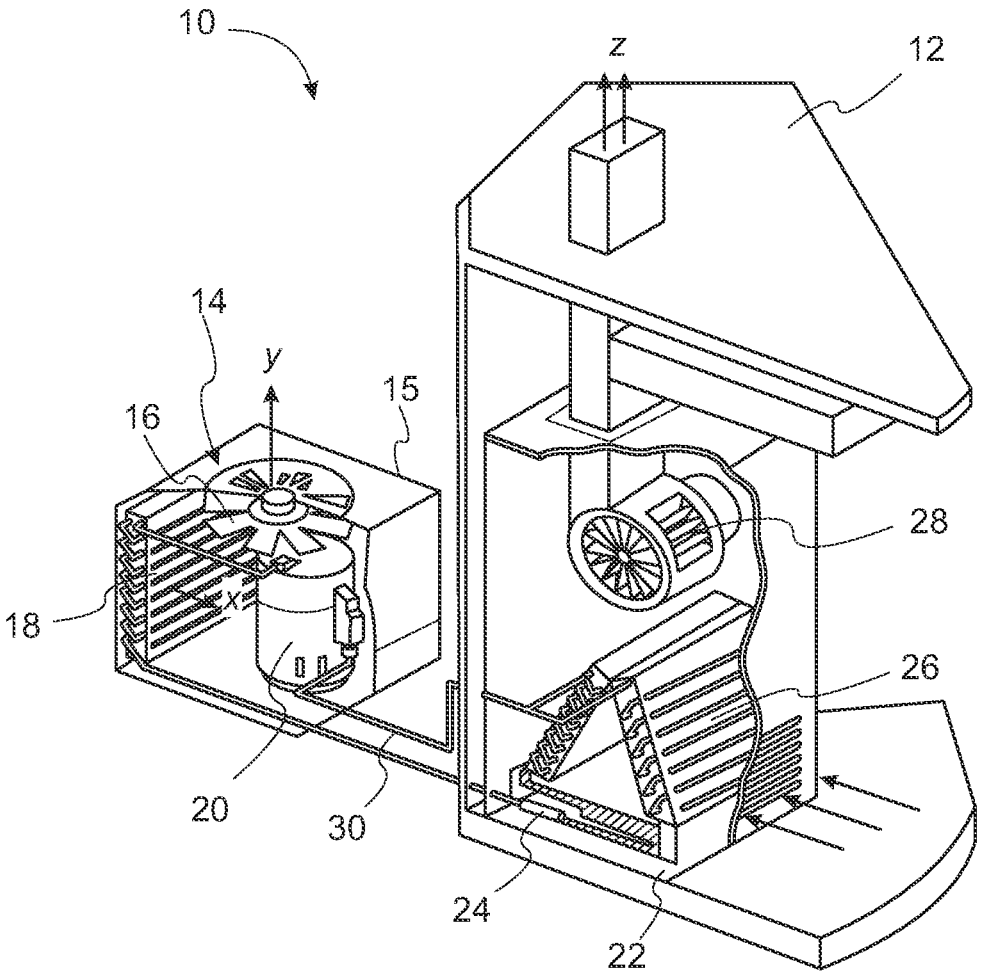
FIG. 1 shows an illustrative configuration of a heating, ventilation and air conditioning system in connection with which the present invention is suitable for use.

Sunlight radiating on the outdoor condenser unit of a heating ventilation and air conditioning ("HVAC") system can raise the surface temperature of the condenser unit as high as 144 degrees Fahrenheit, particularly those made of metal, and even those made of plastic. This becomes more severe, the more the direct the sunlight, which can vary by longitude and season but is possible anywhere. Direct sunlight radiating on the cooling coils on a condenser unit or its housing can increase the overall temperature of the housing and the cooling coils of the outdoor condenser unit, thereby reducing the ability to transfer heat from the refrigerant passing through the cooling coils of the condenser unit. As the temperature of the condenser unit and its components increases, the condenser unit must work harder to release heat from the associated building structure and to provide refrigerant to the air handler insider the structure. This reduces efficiency, creates difficulties in cooling, increases the costs of conditioning the air in the attached structure, and places unnecessary demand on the grid.

Higher and longer runtimes on the condenser unit lead to increased wear and tear on the unit, resulting in more frequent repaint and maintenance requirements and shortening the lifespan of the HVAC system, particularly of the condenser unit, which is the heart of the HVAC system. Additionally, heat and ultraviolet rays from the sun speedily deteriorate the outer housing surrounding the condenser unit and the interior components inside the condenser unit, particularly rubber or plastic washers, gaskets, hoses, seals, and the like.

Shading the condenser unit can increase the efficiency of the condenser unit by an estimated ten percent. Large patio umbrellas, tarps and awnings are used to provide shade for condenser units. HVAC professionals recommend against shading with umbrellas, tarps or awnings because these hinder the escape of the hot exhaust from the condenser unit and recirculate the heated air into the cooling process. These devices also have a very limited shade trajectory that would require continuous repositioning to be effective, or they require multiple umbrellas, further restricting fresh air flow around the condenser unit.

Foliage can provide effective shade, and, in some ways, foliage is preferable over umbrellas or tarps. However, trees must grow and reach an adequate height to cast a shadow long enough to shade the condenser unit. Trees are expensive and slow growing, taking many years to reach maturity for shading. Alternatively, shorter foliage, such as shrubs and bushes, are more affordable and faster growing. By reason of the smaller size of shrubbery, this type of foliage is grown close to the condenser unit in order to provide shade, which is undesirable. The close proximity restricts air flow around the condenser unit and sheds leaves, sticks and other debris that clog the cooling, or condenser, coils.

In an effort to minimize the effects of the sun, covers may be installed over the condenser unit to shield it from the deleterious effects of the sun and attempt to mitigate the accumulation of debris in the condenser unit. When covering the condenser unit, it is important to provide sufficient distance between the roof and the exterior walls of the associated structure, or other articles surrounding the condenser unit, so as not to impede airflow. Many conventional covers fail to allow sufficient airflow into the condenser unit or block the exhaust of hot air from the condenser unit.

Conventional covers may partially or completely impede air flow from the unit, causing hot exhaust from the unit to be recirculated and reducing the amount of heat removed from the circulating refrigerant, which may damage the condenser unit. Additionally, some conventional covers surround all walls of the housing of the condenser unit, impeding the flow of air into the unit and the release of hot air from the unit. For example, reflective fabric or polymer covers may be strapped to or wrapped around the condenser unit to block the sun and debris, but this also restricts air flow. Self-supporting louvered wood or plastic covers which surround the condenser unit without making contact offer less blockage and permit some air circulation, although they still hinder air flow.

Some conventional covers are made of mesh and do not effectively block the penetration by sunlight onto or into the condenser unit. Rather, these covers merely minimize the deposition of debris and dirt inside the condenser unit. Additionally, these mesh covers may rest directly on the top of the housing of the condenser unit, which partially or completely inhibits the flow of exhaust air from the condenser unit.

Another conventional shade, in the form of a pitched roof positioned over the top of the housing of the condenser unit, offers an inclined surface for runoff water and rain but fails to protect the sides of the housing from the sun. Depending upon the time of day, the pitched roof may provide some partial shade from the sun beating on the top of the condenser unit but it leaves the sides of the unit completely exposed and absorbing radiant heat from the sun.

This present invention overcomes the deficiencies of conventional HVAC shades, covers and foliage. The present invention provides a shade for an outdoor condenser unit of an air conditioning system and acts as a shield and cooling device for the condenser unit to minimize overheating and to improve airflow around the unit. The present invention comprises a frame with a shade positioned so as to extend radially from the top of the housing of the condenser unit. The shade projects radially away or outwardly from the condenser unit to shield the condenser unit from the sun. The fan of the condenser unit is uncovered to prevent obstruction of airflow, while the shade keeps the condenser unit cool and provides optimal operating conditions for the condenser unit. Various securements maintain the shade in working engagement with the condenser unit.

The present invention leaves a separation space between the hot exhaust air exiting from the condenser unit and allows fresh air to be pulled in and to circulate over the coils, thus further improving the efficiency of the unit and reducing run times. The present invention provides a shade that extends radially from the top of condenser unit, thereby creating shade over the condenser coils and the surrounding concrete and creates a separation of heated air above the shade and fresh air below. The present invention enables the hot side of the HVAC system to remove more heat from the circulating refrigerant before returning it to the condenser unit. The present invention improves air conditioner functionality while saving money on utility costs and reducing demand on the grid. The present invention is economical. These and other advantages of the invention will be apparent from the following description.

Turning now to the drawings in general, and to FIG. 1 in particular, there is shown therein an illustrative HVAC system 10 for conditioning the air of an attached residential home, commercial structure or other building. The present invention is applicable for use in connection with a variety of different types of HVAC systems, whether residential, commercial or industrial, including, without limitation, the illustrative HVAC system shown herein. To facilitate the description of the invention and the utility of the invention, an illustrative, although not exhaustive, HVAC system will be discussed. It will be appreciated that the HVAC system described herein and its illustrative configuration shown in FIG. 1 are provided by way of example only, and that the present invention is applicable for use in other types of HVAC systems, constructions and configurations.

FIG. 1 shows an HVAC system 10 for a structure 12. The hot side of the HVAC system 10 comprises an outdoor condenser unit 14, having a housing 15 enclosing or supporting a fan 16, condenser coils 18 and a compressor 20. The condenser unit 14 generally is constructed proximal the exterior of the structure 12. In the interior of the structure 12, the cold side of the HVAC system 10 comprises an air handler 22, an expansion valve 24, evaporator coils 26 and a blower 28. A refrigerant line 30 transports refrigerant between the compressor 20 and the evaporator coils 26 of the HVAC system 10, while the expansion valve 24 regulates the flow of refrigerant into the evaporator coils 26.

In operation, the compressor 20 puts the refrigerant (not shown) under pressure, which creates heat. As the pressure of the refrigerant increases, the temperature of the refrigerant also increases, and the refrigerant converts to a gaseous state. The heated refrigerant travels through the condenser coils 18, where heat transfers from the refrigerant to the condenser coils, thereby increasing the temperature of the condenser coils. Heat is drawn from the air by means of the refrigerant passing through condenser coils 18 and cooling the refrigerant. The fan 16 pulls ambient air into the condenser unit 14 through the condenser coils 18 in direction x and blows the heated air emanating from the condenser coils away from the condenser unit upward in direction y. For this reason, it is important that no obstructions impede the free flow of air into or away from the condenser unit 14. The fan 16 illustrated in FIG. 1 is an axial fan having a motor-driven rotating shaft on which are mounted blades that pull air and force it away from the condenser unit 14 in a direction parallel to the shaft of the fan, which is shown as direction y.

After passing through the condenser coils 18, the refrigerant is cooled and converts back to a liquid state. The compressor 20 sends the cold, pressurized liquid refrigerant to the cool side of the HVAC system 10, through the expansion valve 24 into the evaporator coils 26 inside the air handler 22. Hot air pulled from inside the associated structure 12 through a return duct flows over the cold evaporator coils 26. The blower 28 pumps the chilled air out of the air handler 22 in direction z through supply ducts installed throughout structure 12 into the various rooms of the structure. The refrigerant inside the evaporator coils 26 absorbs heat from the warm air in the structure 12. Hot air flows over the cold, low pressure evaporator coils 26, and the refrigerant converts from a liquid back to a gas. The compressor 20 pumps the refrigerant back to the condenser unit 14, where the process is repeated.

Figure 2:
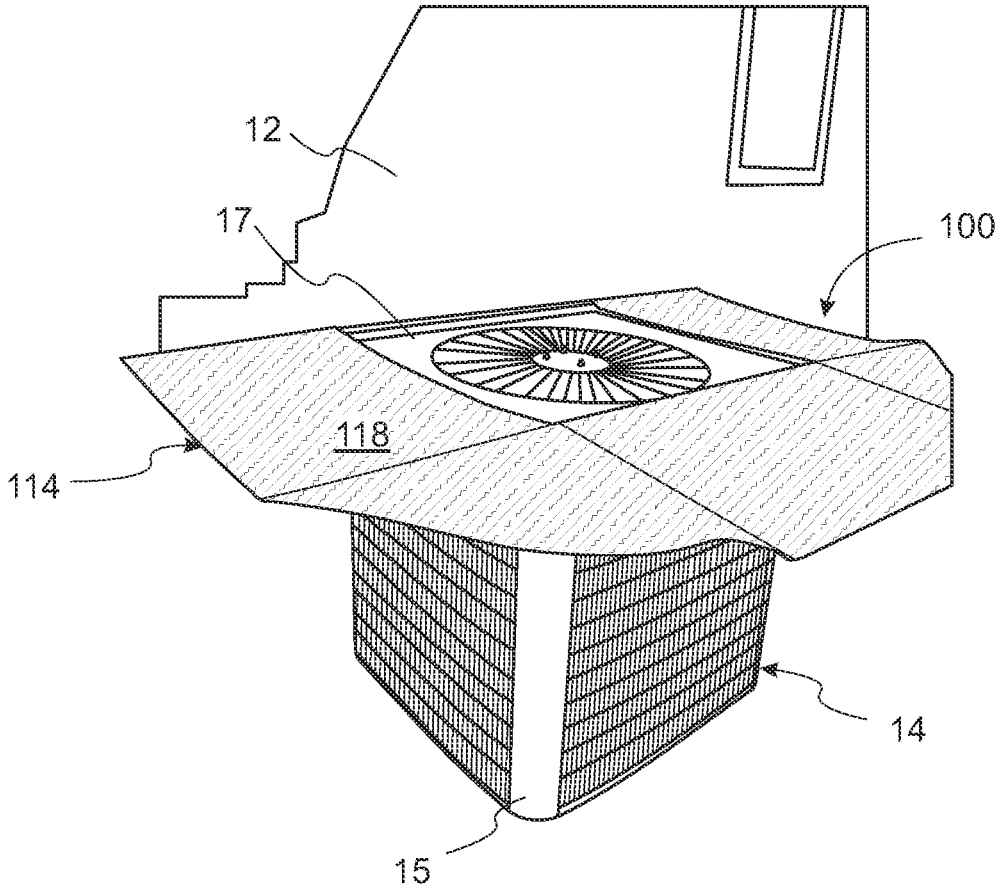
FIG. 2 is a perspective view of an illustrative shade of the present invention in assembled configuration with the condenser unit of a heating, ventilation, and air conditioning system.

With the importance of the condenser unit 14 now understood, an illustrative shade 100 is shown in FIG. 2 installed on the housing 15 of a condenser unit 14 of an HVAC system 10. The condenser unit 14 is installed abutting an exterior wall of the structure 12 associated with the HVAC system 10.

Figure 3:
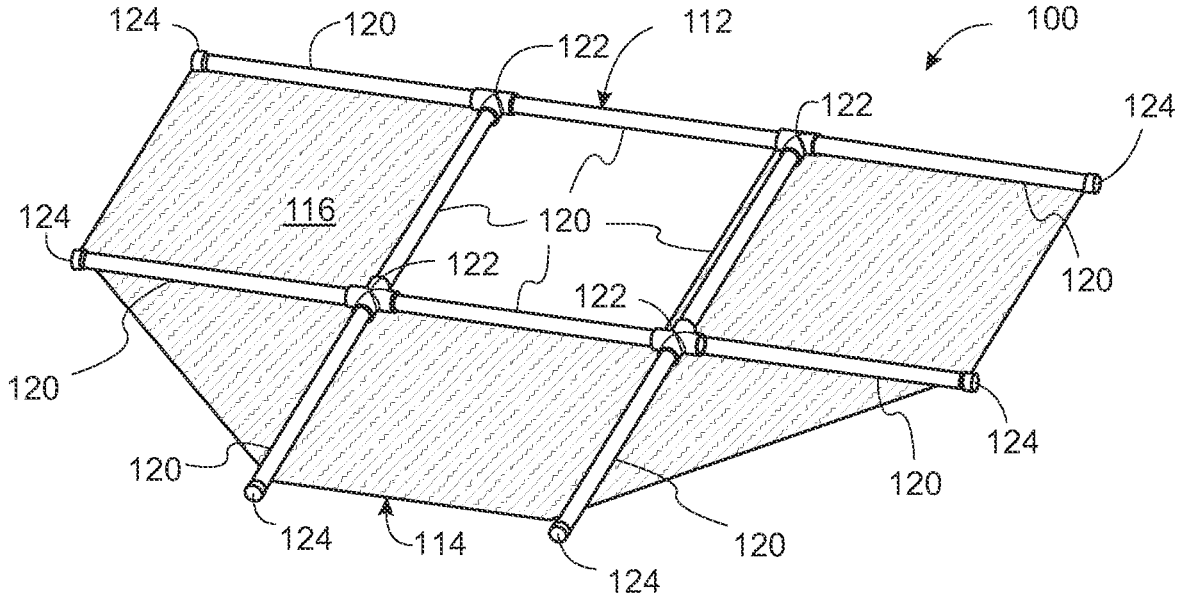
FIG. 3 is a view of the interior canopy and frame of an illustrative shade of the present invention.
Figure 4:
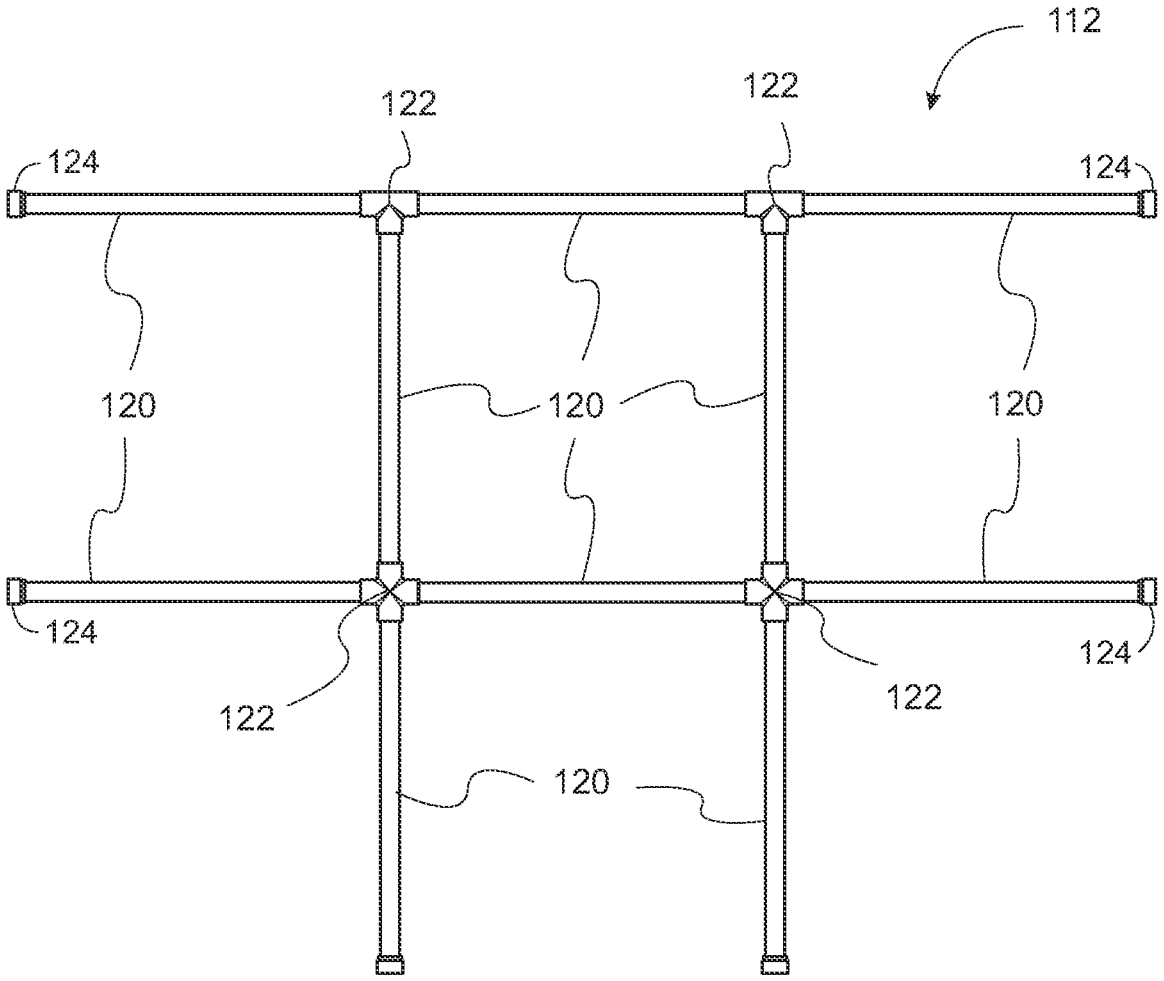
FIG. 4 is a view of the frame of an illustrative shade of the present invention.
Figure 5:
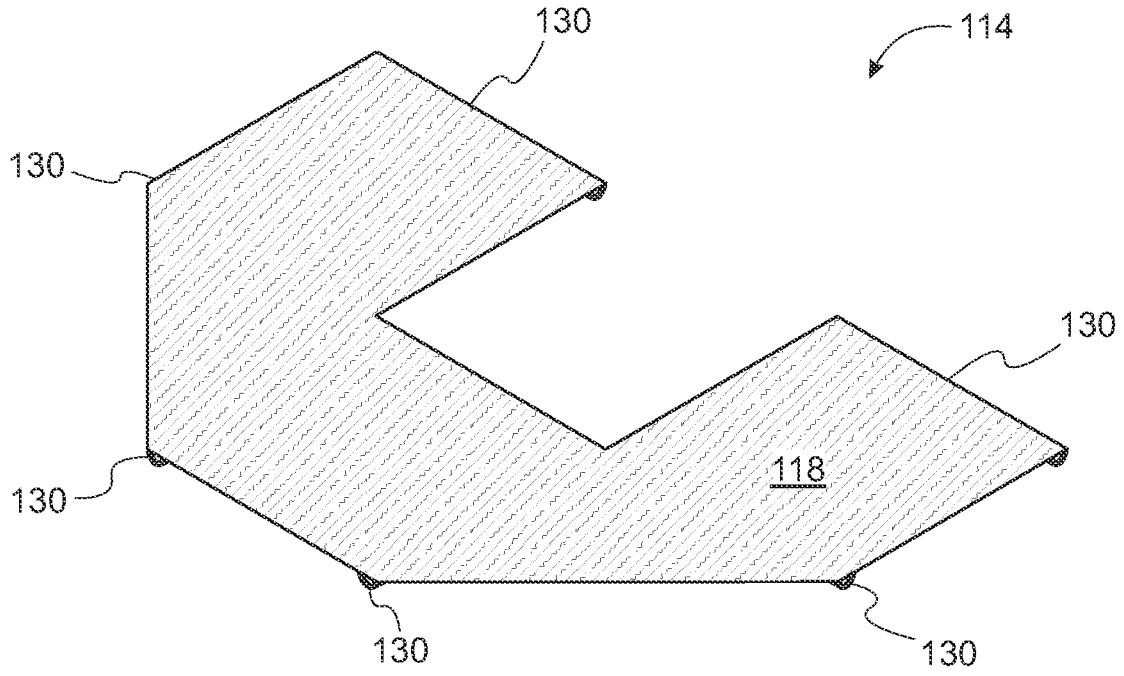
FIG. 5 shows the outer canopy of an illustrative shade of the present invention.

With continuing reference to FIG. 2, and turning now to FIGS. 3, 4, and 5, the shade 100 comprises a frame 112 and a canopy 114. The canopy 114 has an inner canopy 116 and an outer canopy 118. When in assembled configuration, the inner canopy 116 is positioned proximal to and toward the housing 15 of the condenser unit 14, while the outer canopy 118 is positioned distal from and opposite the housing of the condenser unit. The frame 112 and canopy 114 are shown in assembled configuration in FIG. 3 so that the inner canopy 116 and frame 112 are visible for illustration purposes. When installed on a condenser unit 114, the outer canopy 118 would be visible from above the condenser unit 114.

The frame 112 may be constructed from any material suitable for use in outdoor HVAC applications, including wood, plastic, fiber glass, carbon fiber, metal and combinations thereof. Thermoset plastics such as polyurethane, epoxy, phenolic, and certain polyesters, and combinations thereof, are suitable for us in manufacturing the frame 112 of the shade 100. In applications where cost and corrosion concerns are at issue, the frame 112 may be formed from thermoplastics, including polyethylene (PE), polystyrene (PS), polypropylene, polyvinyl chloride (PVC), polyester, nylon, thermoplastic olefins, santoprene, acrylonitrile butadiene styrene (ABS), acetals, polyoxymethylene, polyvinyl chloride, ultra-high molecular weight polyethylene (UHMWPE), high density polyethylene (HDPE), polytetrafluoroethylene (PTFE), cross-linked polyethylene (PEX), and various nylons, such as nylon 6, nylon 66, nylon 6/6-6, nylon 6/9, nylon 6/10, nylon 6/12, nylon 11, or nylon 12, and combinations of the foregoing. Where strength and durability are important factors, the frame 112 may be made from metals and galvanized metals, including aluminum, copper, brass, steel, stainless steel and alloys thereof. These metals are suitable for use in connection with HVAC applications in commercial and industrial applications. These metals also resist the corrosive effects of water and other chemicals. The material comprising the frame 112 of the shade 100 preferably is neither overly flexible, conformable or deformable in order to create sufficient support for the canopy 114. In one embodiment of the invention, the frame 112 is comprised of PVC for rigidity, durability, corrosion-resistance and light weight. In another embodiment of the invention, the frame 112 is comprised of ¾ inch (1.905 centimeter) schedule 40 furniture grade PVC tubing.

It will be appreciated that the frame 112 may form any shape suitable for supporting the canopy 114 and may be configured to the shape of the canopy and the condenser unit 14. Often, condenser units 14 are built in the shape of a cube, rectangular prism or cuboid, in which case, a frame 112 forming a grid pattern may effectively support the canopy 114. Moreover, a condenser unit 14 often is constructed in close proximity to the structure 12 associated with the HVAC system, leaving minimal space between the condenser unit and the structure. To that end, the frame 112 may be adapted to provide shade for the condenser unit 14 on three sides of the cube, rectangular prism or cuboid-shaped condenser unit. It will be appreciated, however, that the frame 112 may be constructed to support the canopy 114 so that the shade 100 shields the condenser unit 14 on one, two, three or all four sides of the condenser unit.

The frame 112 of the shade 100 may comprise an integral one-piece construction or may be constructed of multiple components that are secured together to create a unified supporting frame 112. The frame 112 comprises a plurality of ribs 120 which are configured to support the canopy 114. The ribs 120 help resist the damaging effects of wind and other elemental forces by giving flexibility to the frame 112 while also offering strength and support for the canopy 114. The ribs 220 may be any shape, including square or round in cross section. The ribs 120 are assembled into a desired configuration using connectors 122, such as bolts, screws, nuts, nails, welds, joinery, couplers, and pipe fittings, including t-caps, three-way caps and four-way caps. In one embodiment of the invention, the frame 112 forms a grid array wherein the ribs 120 are connected in assembled configuration by t-caps, three-way, and four-way pipe fittings 122.

The frame 112 may further comprise plugs or caps 124 at the exposed ends of the ribs 120 that are not connected to other ribs by connectors 122. The plugs or caps 124 may be made of rubber, plastic, metal, PVC or other materials and serve to protect the ends of the ribs 120, which may be abrasive or sharp, and minimize damage to the condenser unit 14, the canopy 114 or to items or people in the vicinity of the frame 112.

With continuing reference to FIGS. 2, 3, 4, and 5, the canopy 114 of the shade 100 may be made from any material that blocks or inhibits sunlight and/or ultraviolet rays. For example, some suitable materials useful in constructing the canopy 114 of the shade 100 include densely woven cloth, such as denim, canvas, or wool, and synthetic materials, such as polyurethane, polyester, polyethylene, high density polyethylene, nylon, pongee fabric, coated spun nylon, solution-dyed polyester, olefins, acrylic, ripstop fabrics and solar outdoor shade materials. The canopy 114 may be constructed from a single layer of material or from layers of materials. Layered canopies help create a separation barrier between hot air exiting from the fan, and cooler ambient air drawn into the condenser unit over the condenser coils 18. It will be appreciated that the canopy 114 could also may be constructed from wood, metal, solid or vented materials, and porous or waterproof materials.

The canopy 114 of the shade 100 may comprise an integral one-piece construction or may be constructed of multiple components that are secured together. In the latter case, the components of the canopy 114 may be secured together with various means, such as hook and loop closures or ties or may be sewn together with thread.

As shown in FIG. 5, the canopy 114 may further comprise pockets, grommets, or gussets 130 for receiving the ribs 120 of the frame 112. Alternatively, hook and loop closures may be employed to secure the frame 112 to the canopy 114.

The canopy 114 may be any shape to effectively shield the condenser unit 14 from the sun. The shape of the canopy 114 should complement and enhance the function of the condenser unit 14 and must not impede the flow of hot air expelled from the condenser unit 14 by the fan 16 nor impede the flow of ambient air drawn in to the condenser unit through the condenser coils 18. As explained in conjunction with the frame 112, condenser units 14 often are built in the shape of a cube, rectangular prism or cuboid and are installed in close proximity to the structure 12 associated with the HVAC system 10. To that end, the canopy 114 may be adapted to provide shade for the condenser unit 14 on three sides of the cube, rectangular prism or cuboid-shaped condenser unit. It will be appreciated that the canopy 114 of the shade 100 may constructed to shield the condenser unit 14 on one, two, three or all four sides of the condenser unit 14. In those circumstances when the condenser unit 14 is not a cube, rectangular prism or cuboid shape, it will be appreciated that the canopy 114 may be any shape adapted to the shape of the condenser unit 14 that will effectively shield the condenser unit from the deleterious force of the sun. In one embodiment of the invention, the canopy 114 is constructed in a generalized wing shape geometrically comprising a fusion of either two squares and a trapezoid or two rectangles and a trapezoid. This geometric configuration shields not only the sides of the condenser unit 14, but also offers shade to the exposed corners of the cube, rectangular prism or cuboid shaped condenser unit 14, particularly as the day progresses and the relative position of the sun changes. It will be appreciated, however, that the shade 100 accomplishes the advantages of the invention even when the corners of the condenser unit 14 are exposed to the sun.

It now will be appreciated that the shade 100 is placed in operative engagement with the condenser unit 14 in a manner so as not to impede the flow of hot air expelled from the condenser unit by the fan 16. Additionally, the shade 100 is placed in engagement with the condenser unit 14 so as not to impede the flow of ambient air drawn into the condenser unit 14 by the action of the fan 16 through the condenser coils 18, which cools the refrigerant flowing through the HVAC system 10. In those condenser units 14 where the fan 16 pulls hot air and forces it away from the condenser unit 14 in an upward direction z, as shown in FIG. 1, the shade 100 is secured to the housing 15 of the condenser unit so as to extend radially from or near a top surface 17 of the housing 15, without covering the fan. The shade 100 projects radially away or outwardly from the condenser unit 14 to protect and shield the condenser unit and its interior components, as well as the surrounding substrate. The fan 16 of the condenser unit 14 is uncovered to prevent obstruction of airflow, while the shade 100 keeps the condenser unit 14 cool and provides optimal operating conditions for the condenser unit. The shade 100 also creates a separation barrier between hot exhaust air exiting from the condenser unit 14 on top above the exterior canopy 118 and fresh air drawn in to the condenser coils 16 below the interior canopy 116, thus further improving the efficiency of the unit and reducing run times.

Figure 6:
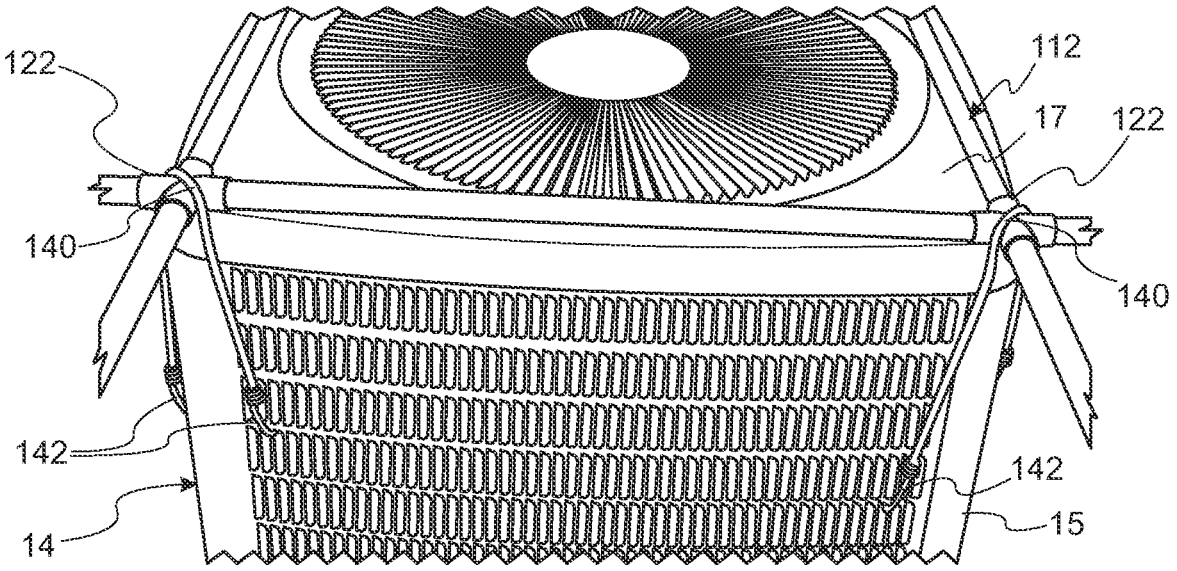
FIG. 6 shows an illustrative frame of the present invention held in assembled configuration with a condenser unit by means of bungee cords.
Figure 7:
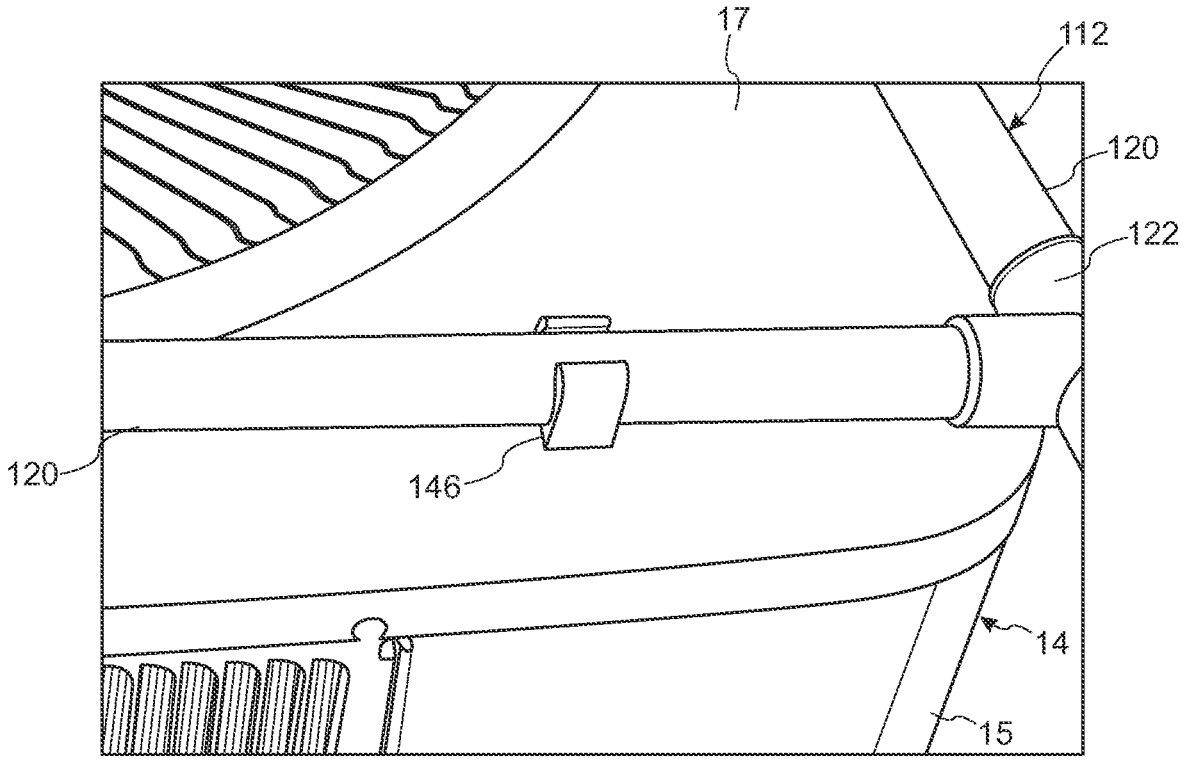
FIG. 7 shows an illustrative frame of the present invention held in assembled configuration with a condenser unit by means of tubing clamps.

Various types of securements maintain the shade 100 in working engagement with the condenser unit 14. Turning now to FIGS. 6 and 7, the shade 100 is secured in operative engagement with the condenser unit 14 via various securement means, including bungee cords, clips or tubing clamps mounted to the condenser unit 14, hook and loop closure, screws or bolts. In one embodiment of the invention, as shown in FIG. 6, the frame 112 of the shade 100 is secured to the frame 15 of the condenser unit 14 by bungee cords 140 with hooks 142. The bungee cords 140 may be placed in any location on the housing 15 which secures the frame 112 to the condenser unit 14. In one embodiment of the invention, the bungee cords 140 are looped over or around the connections or fittings 122 of the frame 112 and are stretched until the frame is held securely against the housing 15. Hooks 142 at each end of each of the bungee cords 140 are hooked into vents in the housing 15. Positioning the bungee cords 140 over and/or around the connectors 122 enables the frame 112 to withstand pressure, twisting, whipping and elemental forces so as not to place unnecessary pressure on the ribs 120. However, it will be appreciated that bungee cords 140 may also be situated on or around or over the ribs 120 of the frame 112 distant from the connectors 122.

Additionally, as shown in FIG. 7, clips or tubing clamps 146 effectively secure the frame 112 to the condenser unit 14. Placement of the clips or tubing clamps 146 is variable, based upon the size and shape of the condenser unit 14. In one embodiment of the invention, tubing clamps 146 are secured on the top 17 of the housing 15 of the condenser unit 14 so as to receive opposing ribs 120 of the frame 112, proximal the connectors 122. If the size or other conditions of the condenser unit 14 do not permit placement near the connectors 122, tubing clamps 146 may be placed on the top 17 of the housing 15 so as to receive the ribs 120 at a point along the center length of the ribs 120.

Figure 8:
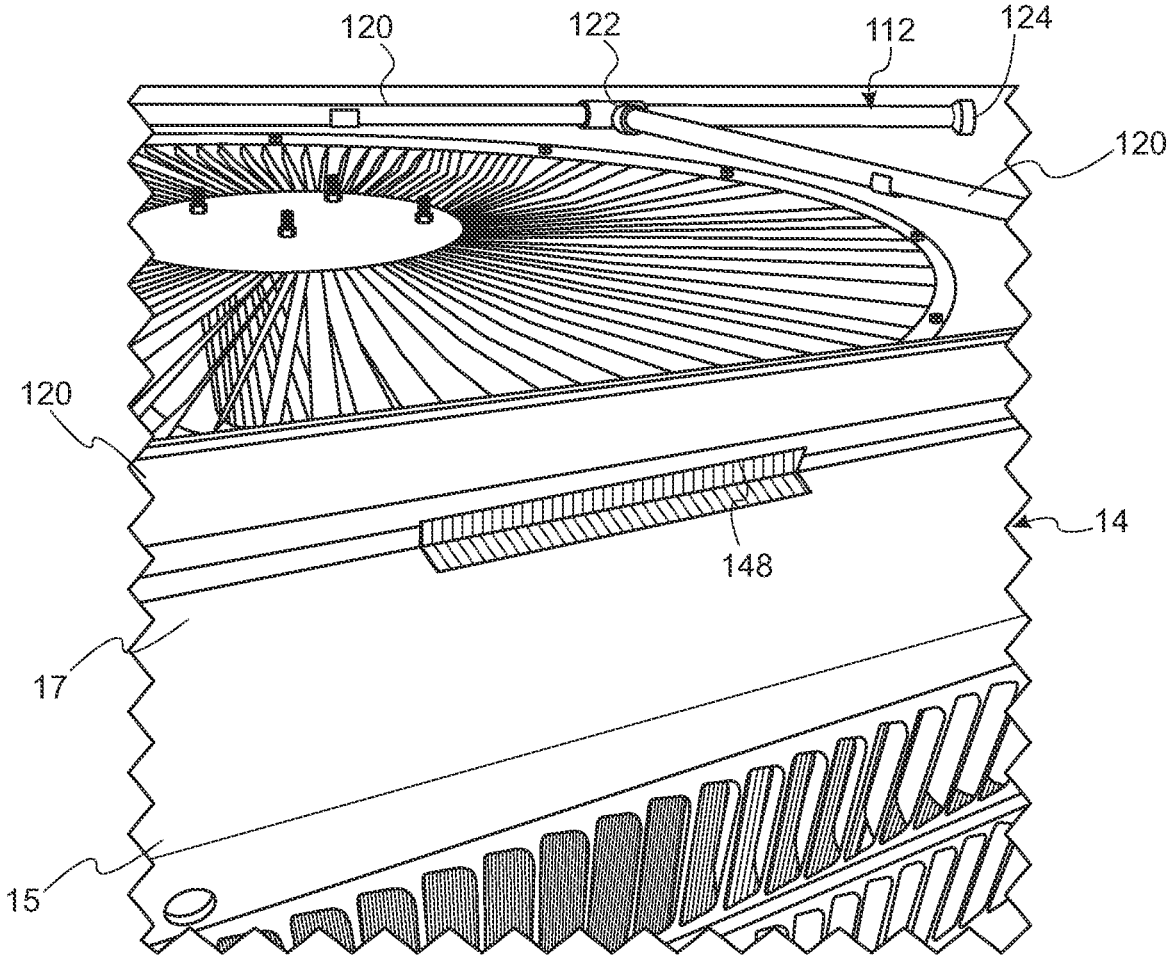
FIG. 8 shows an illustrative frame of the present invention held in assembled configuration with a condenser unit by means of hook and loop closures.

Additionally, as shown in FIG. 8, hook and loop closures 148 may be employed to secure the frame 112 to the housing 15 of the condenser unit 14. Hook and loop closures 148 may be placed on the housing 15 so as to attach the frame 112 to the housing proximal the connectors 122 and aid the frame to withstand elemental forces. However, it will be appreciated that the hook and loop closures 148 may also be situated in other locations on the housing to effectively secure the frame 112.

The dimensions of the frame 112 and the canopy 114 are variable, depending upon the size and location of the condenser unit 14, the location of other structures or items proximal the condenser unit, and other conditions applicable to the site where the shade 100 is in use. Generally, the canopy 114 of the shade 100 may project radially from the housing 15 a distance ranging from about 10 inches (25.4 centimeters) to about 40 inches (101.6 centimeters). In one embodiment of the invention, the canopy 114 of shade 100 may project radially from the housing 15 a distance ranging from about 14 inches (35.56 centimeters) to about 20 inches (50.8 centimeters).

The shade 100 can be made with set sizes to match the dimensions of a condenser units 14, or the shade 100 may be constructed with an adjustable frame 112 to either pair with fixed canopy 114 sizes or variable canopy sizes. For example, the size of the frame could range from 10 inches (25.4 centimeters) in diameter to 70 inches (128 centimeters) in diameter, depending upon the measurements of the condenser unite 14.

Figure 9:
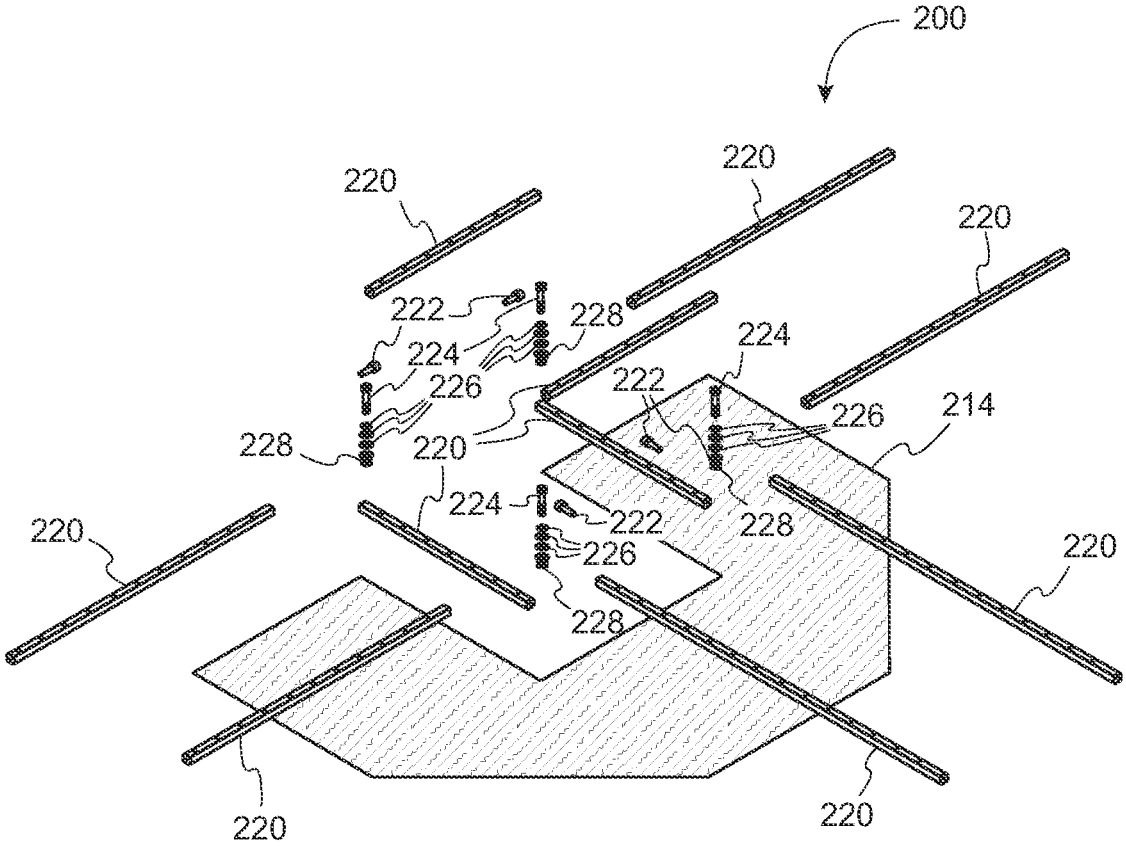
FIG. 9 shows an alternative illustrative shade of the present invention comprising a telescoping frame adapted to fit various sizes of condenser units.

Turning now to FIG. 9, an adjustable shade 200 is shown. The adjustable shade 200 comprises an adjustable frame 212, shown in exploded view in FIG. 9, and a canopy 214. The adjustable frame 212 would entail a single frame adapted to fit many different-sized condenser units 14. The adjustability of the frame 212 may be achieved with telescoping tubes or ribs 220 wherein a first rib fits inside and slides inside a second rib, enabling extension into a longer rib. The telescoping ribs 220 of the frame 212 may be secured through methods such as spring retention push buttons, set screws, internal tensions, screws, bolts, and the like, or pipes that overlap and bolt together. In one embodiment of the invention, the telescoping means for the ribs 220 of the adjustable frame 212 comprise spring steel button pins 222, head screws 224, a plurality of washers 226, and a locknut 228. The adjustable frame 212 may be made from any material, including aluminum or any of the materials from which the frame 112 may be constructed, and the ribs 220 may be any shape, including square or round in cross section.

Example 1

The efficiency and utility of a shade 100 constructed in accordance with the present invention is demonstrated by the following example. On a sunny day, when the outdoor ambient temperature was 97 degrees Fahrenheit (36 degrees Celsius), the following test was conducted. A shade 100 comprising a frame 112 and canopy 114 were installed on the housing 15 of a condenser unit 14. The frame was made of wood. The canopy 114 was made of a double layer thickness of an outdoor solar shade material constructed from high density polyethylene having a high ultraviolet ray blockage capacity and was formed of three rectangular-shaped components that extended radially from the housing 15 of the condenser unit a distance of approximately 14 inches (35.56 centimeters) on three sides of the housing. The canopy 114 was constructed so as not shield the corners of the housing 15 of the condenser unit 14 and allowed the sun to radiate onto the corners of the housing.

Figure 10:
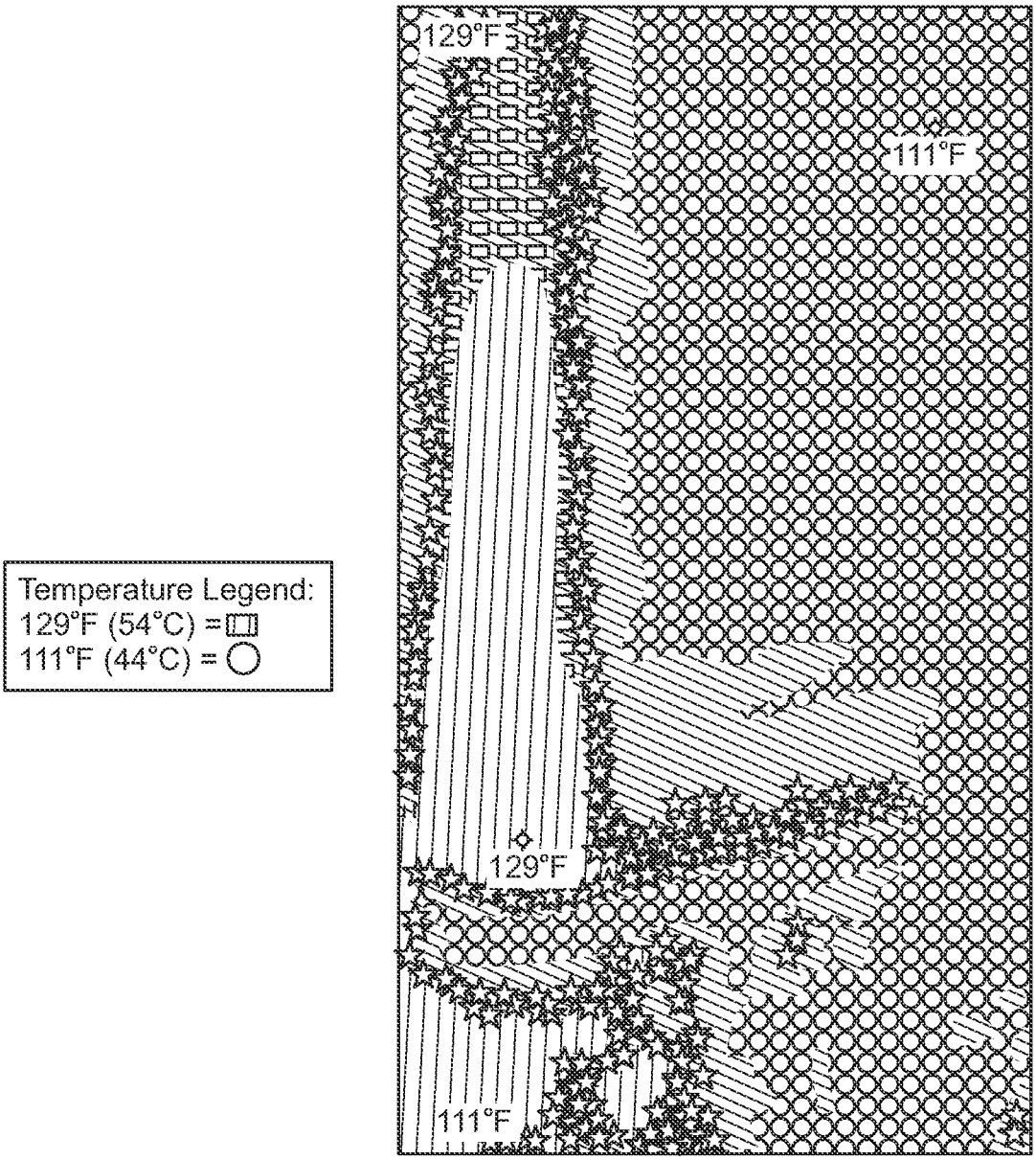
FIG. 10 shows the temperature gradient of a condenser unit shielded on a sunny day by an illustrative shade of the present invention.

As shown in FIG. 10, the temperature gradient of the housing 15 was measured by use of a thermal imaging camera and produced test data showing nearly a twenty degree delta between the temperature of the housing 15 shielded from the sun by the canopy 114 and the temperature of the housing exposed to the sun. The shaded sides of the housing reached a temperature of 111 degrees Fahrenheit (44 degrees Celsius), whereas the exposed corners of the housing reached a temperature of 129 degrees Fahrenheit (54 degrees Celsius).

Example 2

The efficiency and utility of a shade 100 constructed in accordance with the present invention further is demonstrated by the following example. On a partly cloudy day, when the outdoor ambient temperature was 90 degrees Fahrenheit (32 degrees Celsius) the following test was conducted. A shade 100 comprising a frame 112 and canopy 114 were installed on the housing 15 of a condenser unit 14. The frame was made of wood. The canopy 114 was made of a double layer thickness of an outdoor solar shade material constructed from high density polyethylene having a high ultraviolet ray blockage capacity and was formed of three rectangular-shaped components that extended radially from the housing 15 of the condenser unit a distance of approximately 14 inches (35.56 centimeters) on three sides of the housing. The canopy 114 was constructed so as not shield the corners of the housing 15 of the condenser unit 14 and allowed the sun to radiate onto the corners of the housing.

Figure 11:
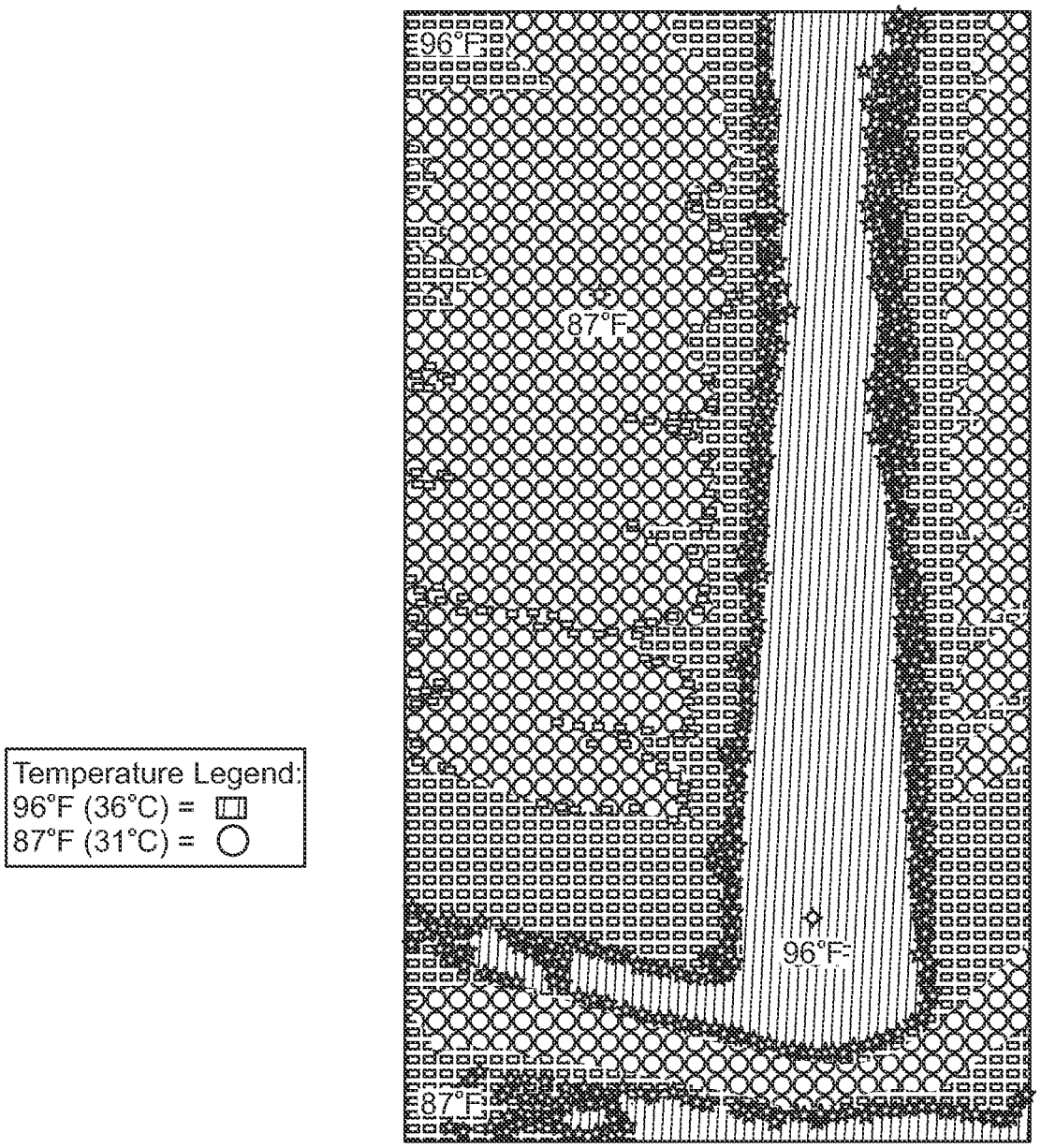
FIG. 11 shows the temperature gradient of a condenser unit shielded on a partly cloudy day by an illustrative shade of the present invention.

As shown in FIG. 11, the temperature gradient of the housing 15 was measured by use of a thermal imaging camera and produced test data showing nearly a nine degree delta between the temperature of the housing 15 shielded from the sun by the canopy 114 and the temperature of the housing exposed to the sun. The shaded sides of the housing 15 reached a temperature of 87 degrees Fahrenheit (31 degrees Celsius), whereas the exposed corners of the housing reached a temperature of 96 degrees Fahrenheit (36 degrees Celsius). This delta equates to a measurable increase in the efficiency of the condenser unit by ten percent (10%).

The comparative data of the temperature gradient of the housing 15 of the condenser unit 14, measured on a sunny day versus a partly cloudy day, shows that the shade 100 is effective at shading the housing 15 and its interior components and delivering a pronounced reduction in the temperature of the housing. This reduced temperature equates to a measurable increase in the efficiency of the unit by 10%.

The present invention further is directed to a method of increasing the efficiency of an HVAC system 10. The foregoing description is incorporated herein. The method increases the efficiency of a heating, ventilation, and air conditioning unit comprising a condenser unit having a top and four sides. The method comprises the step of shading one or more of the sides of the condenser unit from the sun by providing a canopy that extends radially from the condenser unit. The method may further comprise the step of shading one or more of the sides of the condenser unit comprises providing a canopy that extends radially from the top of the condenser unit. The method may further comprise the step of creating a separation barrier between hot air exiting the condenser unit and ambient air entering the condenser unit. The method may further comprise the step of shading one or more of the sides of the condenser unit comprises providing a canopy that extends radially from at least three sides from the top of the condenser unit. The method may further comprise the step of assembling the canopy on a frame. The method may further comprise the step of securing the frame proximal the top of the condenser unit.

It now will be appreciated that the present invention overcomes the deficiencies of conventional HVAC shades, covers and foliage. The present invention presents a shade for an outdoor condenser unit of an air conditioning system and acts as a shield and cooling device for the condenser unit to minimize overheating and to improve airflow around the unit. The present invention comprises a frame with a canopy positioned so as to extend radially from the top of the housing of the condenser unit. The canopy projects radially away or outwardly from the condenser unit to shield the condenser unit from the sun. The fan of the condenser unit is uncovered to prevent obstruction of airflow, while the shade keeps the condenser unit cool and provides optimal operating conditions for the condenser unit. The canopy creates shade over the condenser coils and the surrounding concrete and creates a separation of heated air above the shade and fresh air below. The present invention leaves a separation space between the hot exhaust air exiting from the condenser unit and allows fresh air to be pulled in and to circulate over the coils, thus further improving the efficiency of the unit and reducing run times. The present invention enables the hot side of the HVAC system to remove more heat from the circulating refrigerant before returning it to the condenser unit. The present invention improves air conditioner functionality while saving money on utility costs and reducing demand on the grid. The present invention is economical.

The invention has been described above both generically and with regard to specific embodiments. Although the invention has been set forth in what has been believed to be preferred embodiments, a wide variety of alternatives known to those of skill in the art can be selected with a generic disclosure. Changes may be made in the combination and arrangement of the various parts, elements, steps and procedures described herein without departing from the spirit and scope of the invention as defined in the following claims.

I claim:

1. A removable shade for a heating, ventilation and air conditioning system comprising a condenser unit having a top and four sides, the shade comprising:

a frame adapted to be secured to the condenser unit, wherein the frame is composed of a lightweight material and is adapted to be secured to the condenser unit proximal the top of the condenser unit and wherein the frame removably connected to the condenser unit without damaging the condenser unit; and a canopy adapted to be secured to the frame, wherein the canopy comprises an integral one-piece unit that, when in assembled configuration with the frame, extends radially and substantially horizontally from the top surface of the condenser unit on at least three sides thereof and forms a shape that substantially shields at least three sides of the condenser unit from the sun;

wherein, the shade is adapted to be received in assembled configuration with the condenser unit so as not to impede the flow of heated air exiting the condenser unit nor the flow of ambient air entering the condenser unit.

2. The shade of claim 1, wherein the canopy forms a separation barrier between heated air exiting the condenser unit and ambient air entering the condenser unit, thus further improving the efficiency of the condenser unit.

3. The shade of claim 1, wherein the frame is constructed from a material selected from the group consisting of polyethylene (PE), polystyrene (PS), polypropylene, polyvinyl chloride (PVC), polyester, nylon, thermoplastic olefins, santoprene, acrylonitrile butadiene styrene (ABS), acetals, polyoxymethylene, polyvinyl chloride, ultra-high molecular weight polyethylene (UHMWPE), high density polyethylene (HDPE), polytetrafluoroethylene (PTFE), cross-linked polyethylene (PEX), and various nylons, such as nylon 6, nylon 66, nylon 6/6-6, nylon 6/9, nylon 6/10, nylon 6/12, nylon 11, or nylon 12, and combinations of the foregoing.

4. The shade of claim 1, wherein the canopy forms a wing shape.

5. The shade of claim 1, wherein the frame comprises a plurality of ribs configured to support the canopy.

6. The shade of claim 5, wherein the plurality of ribs are assembled into a desired configuration to support the canopy.

7. The shade of claim 6, wherein the frame forms a grid array.

8. The shade of claim 1, wherein the canopy is comprised of a material selected from the group consisting of densely woven cloth, denim, canvas, wool, polyurethane, polyester, high density polyethylene, nylon, pongee fabric, coated spun nylon, solution-dyed polyester, olefins, acrylic, ripstop fabrics and solar outdoor shade materials.

9. The shade of claim 5, wherein the canopy comprises pockets, grommets, or gussets adapted to receive the ribs of the frame.

10. The shade of claim 5, wherein the frame comprises a plurality of connectors to connect the plurality of ribs.

11. The shade of claim 10, wherein the plurality of connectors comprises t-caps, three-way pipe fittings, and four-way pipe fittings.

12. The shade of claim 1, wherein the frame is adapted to be connected to the condenser unit via bungee cords, hook and loop closures or clips.

13. The shade of claim 5, wherein the wherein the frame further comprises end caps and the plurality of ribs are adapted to receive the ends caps.

14. The shade of claim 5 wherein the frame is adjustable and the plurality of ribs are telescoping ribs wherein a first rib of the plurality of ribs fits inside and slides inside a second rib of the plurality of ribs, enabling extension into a longer rib.

15. A method of increasing the efficiency of a heating, ventilation, and air conditioning unit comprising a condenser unit having a top and four sides, the method comprising the step of:

shading one or more of the sides of the condenser unit from the sun by providing a shade that extends radially from the condenser unit, wherein the shade comprises:

a frame adapted to be secured to the condenser unit, wherein the frame is composed of a lightweight material and is adapted to be secured to the condenser unit proximal the top of the condenser unit and wherein the frame removably connected to the condenser unit without damaging the condenser unit; and a canopy adapted to be secured to the frame, wherein the canopy comprises an integral one-piece unit that, when in assembled configuration with the frame, extends radially and substantially horizontally from the top surface of the condenser unit on at least three sides thereof and forms a shape that substantially shields at least three sides of the condenser unit from the sun.

16. The method of claim 15, further comprising the step of creating a separation barrier between heated air exiting the condenser unit and ambient air entering the condenser unit.

17. The method of claim 15, further comprising the step of assembling the canopy on the frame.

18. The method of claim 17, further comprising the step of securing the frame proximal the top of the condenser unit so that the canopy extends radially and substantially horizontally from the top surface of the condenser unit on at least three sides thereof and forms a shape that substantially shields at least three sides of the condenser unit from the sun.

19. The method of claim 18 wherein the step of securing the frame proximal the top of the condenser unit comprises the step of removably securing the frame to the condenser unit with a removable securement means.

20. The method of claim 19 wherein the step of removably securing the frame to the condenser unit with a removable securement means comprises the step of supplying bungee cords and looping the bungee cords over or around the frame and removably hooking the bungee cords on or into the condenser unit.

21. The method of claim 19 further comprising the step of removing the shade from the condenser unit without damaging the condenser unit by removing the removable securement means.

* * * * *